United States Patent [19]

Wada et al.

[11] Patent Number: 4,701,576

[45] Date of Patent: Oct. 20, 1987

[54] ELECTRICAL TRANSMISSION LINE

[75] Inventors: Toshio Wada; Tatsuo Hirano, both of Saitama, Japan

[73] Assignee: Junkosha Co., Ltd., Japan

[21] Appl. No.: 866,267

[22] Filed: May 23, 1986

[30] Foreign Application Priority Data

Jun. 6, 1985 [JP] Japan ..... 60-123238

[51] Int. Cl.[4] ..... H01B 11/00

[52] U.S. Cl. ..... 174/117 F; 174/120 R; 174/120 S R; 174/110 F C; 174/110 F; 174/36

[58] Field of Search ..... 174/110 F, 120 R, 120 S R, 174/117 R, 117 F, 36, 110 F C

[56] References Cited

U.S. PATENT DOCUMENTS

| | | | |
|---|---|---|---|
| 4,268,714 | 5/1981 | Mori | 174/36 X |
| 4,368,350 | 1/1983 | Perelman | 174/110 F X |
| 4,468,089 | 8/1984 | Brorein | 174/117 F X |
| 4,472,595 | 9/1984 | Fox et al. | 174/36 |
| 4,486,253 | 12/1984 | Gonia | 174/117 F X |
| 4,588,852 | 5/1986 | Fetterolf et al. | 174/36 |

FOREIGN PATENT DOCUMENTS 1366140 9/1974 United Kingdom ..... 174/120 S R

OTHER PUBLICATIONS

"Fibrous, Porous TFE Provides Dimensional Stability for High Temperature, Low Loss Coaxial Cable"; Insulation/Circuits; Jun. 71; pp. 19-20.

*Primary Examiner*—Morris H. Nimmo

*Attorney, Agent, or Firm*—Mortenson & Uebler

[57] ABSTRACT

An electrical transmission line of the twisted pair of coaxial cable type is provided. One line has a center conductor, a porous plastic dielectric disposed around the outer periphery of the conductor, the dielectric having specific gravity of 0.5 or less, and having a plastic dielectric sheath disposed around the outer periphery of the porous dielectric, the outer sheath having a melting temperature which is 60% or less than the melting temperature of the porous plastic dielectric. The porous plastic dielectric may be in tape form helically wrapped around the conductor, preferably at a wrap angle of 20 degrees or less. The preferred porous dielectric is expanded polytetrafluoroethylene.

3 Claims, 3 Drawing Figures

ELECTRICAL TRANSMISSION LINE

BACKGROUND OF THE INVENTION

The present invention relates to a high-speed electrical signal transmission line employed as a twisted pair cable or a coaxial cable. This type of transmission line often employs a porous polytetrafluoroethylene resin as its dielectric. Examples of a trasmission line which employs a porous polytetrafluoroethylene resin as its dielectric include that in the "Method of Manufacturing Electric Wires Coated with Tetrafluoroethylene Polymer" disclosed in the specification of Japanese Patent Publication No. 21,809/1982. That invention has an arrangement in which, in order to prevent any increase in specific gravity of a porous polytetrafluoroethylene resin layer, an unsintered polytetrafluoroethylene resin tape which has previously been rolled and compressed so that its specific gravity is in the range of 1.85 to 2.2 is wound around the outer periphery of a conductor and is then sintered at a temperature of 327° C. to 400° C. That method, however, still does not completely prevent an increase in the specific gravity of the resin layer. When a conductor having such a resin tape wound thereon is employed as a transmission line, the signal propagation delay time is around 4.0 ns./m, and it is not possible to increase the transmission speed substantially.

In view of the above circumstances, the present inventors have found as the result of zealous examination that the specific gravity of a porous dielectric made of a plastic resin starts to increase when heated at a temperature exceeding 60% of the melting temperature of the resin, and there is virtually no increase in specific gravity of the porous dielectric when heated at a temperature of 60% or less of the melting temperature of the resin.

Accordingly, an object of the present invention is to provide a transmission line in which the specific gravity of a porous plastic dielectric is maintained at 0.5 or less for the purpose of stably providing a transmission characteristic which makes it possible to attain a cable having a signal propagation delay time of about 3.5 ns./m.

SUMMARY OF THE INVENTION

An electrical transmission line is provided comprising a center conductor, a porous plastic dielectric material disposed around the outer periphery of the conductor, the porous dielectric having a specific gravity of 0.5 or less, and a plastic dielectric outer sheath disposed around the outer periphery of the porous dielectric, the outer sheath having a melting temperature which is 60% or less than the melting temperature of the porous dielectric. The porous plastic dielectric is preferably expanded, porous, sintered polytetrafluoroethylene in tape form helically wound around the conductor at a pitch angle of 20 degrees of less with respect to the longitudinal axis of the conductor. The outer sheath may have a rectangular cross-section and a plurality of these units may be bonded together at their respective interfaces to form a multiconductor flat cable transmission line.

DETAILED DESCRIPTION OF THE INVENTION AND PREFERRED EMBODIMENTS WITH REFERENCE TO THE DRAWINGS

An electrical transmission line of the twisted pair or coaxial cable type is provided. One line has a center conductor, porous plastic dielectric disposed around the outer periphery of the conductor, the dielectric having specific gravity of 0.5 or less, and having a plastic dielectric sheath disposed around the outer periphery of the porous dielectric, the outer sheath having a melting temperature which is 60% or less than the melting temperature of the porous plastic dielectric. The porous plastic dielectric may be in tape from helically wrapped around the conductor, preferably at a wrap angle of 20 degrees or less. The preferred porous dielectric is expanded polytetrafluoroethylene.

In this arrangement, as the porous plastic dielectric it is preferable to employ a stretched and sintered porous polytetrafluoroethylene resin. When this is employed in the form of tape, if the tape is wound helically on the conductor at an angle of 20 degrees or less with respect to the longitudinal axis of the conductor, there is, advantageously, substantially no increase in specific gravity of the tape in subsequent processing.

According to the present invention, on the outer periphery of the plastic porous dielectric provided on the outer periphery of the conductor and having a specific gravity of 0.5 or less, theere is provided a dielectric made of a thermoplastic resin the melting temperature of which is 60% or less than the melting temperature of the porous dielectric. The outer dielectric may be provided by melt extrusion so as to form a sheath over the porous dielectric. It is therefore possible to obtain a transmission line which involved substantially no increase in specific gravity of the plastic porous dielectric and which has a stable propagation delay characteristic.

Figure 1:
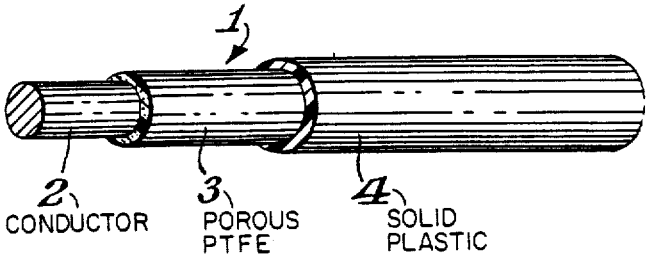
FIG. 1 is a cross-sectional pictorial view of a single-conductor transmission line in accordance with one embodiment of the present invention.

FIG. 1 is a perspective view of an end portion of a single-wire transmission line 1 in accordance with one embodiment of the present invention, the transmission line 1 also being able to be employed as one element of a twisted pair cable or in a multiconductor ribbon cable.

This single-wire transmission line 1 includes a conductor 2, and a porous plastic dielectric 3 provided on the outer periphery of the conductor 2 and made of a stretched and sintered porous polytetrafluoroethylene resin having a specific gravity of 0.5 or less, preferably 0.3. On the outer periphery of the porous dielectric 3 is provided, by melt extrusion, a thermoplastic dielectric sheath 4 having a circular cross-section and made of a vinyl chloride resin (its melting temperature 170° C.) having a melting temperature which is 60% or less of the melting point, i.e., 327° C., of polytetrafluoroethylene resin constituting the porous plastic dielectric 3. In this embodiment, the porous plastic dielectric 3 is covered with the sheath 4 without substantially increasing the specific gravity, that is, 0.3, of the porous dielectric 3, and the porous dielectric 3 which constitutes the inner layer is protected by the sheath 4 made of the thermoplastic dielectric. As a result, it is possible to obtain a stable high-speed transmission line.

It is noted that when a stretched and sintered porous polytetrafluoroethylene resin is employed as the porous dielectric 3, a porous polytetrafluoroethylene tape which has been subjected to extrusion, stretching and sintering may be wound on the outer periphery of the conductor 2, or a porous polytetraflurorethylene resin layer may be formed on the outer periphery of the conductor 2 by other methods. Further, the conductor 2 may be either a single wire or a twisted wire.

Figure 2:
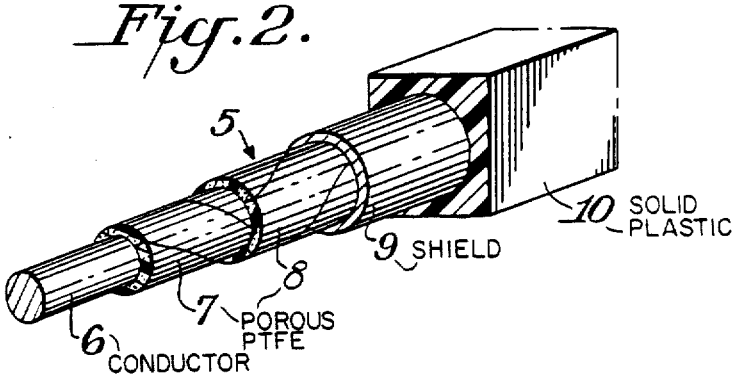
FIG. 2 is a cross-sectional pictorial view of a coaxial transmission line in accordance with another embodiment.

FIG. 2 is a perspective view of a coaxial transmission line 5 in accordance with another embodiment of the present invention.

In the case of this coaxial transmission line 5, a porous plastic dielectric is provided on the outer periphery of conductor 6, the porous dielectric being formed by helically winding stretched and sintered porous polytetrafluoroethylene tapes 7 and 8 in two layers in opposite directions on the outer periphery of the conductor 6 at a pitch angle of 20 degrees or less with respect to the longitudinal axis of the conductor 6. An outer metallic conductor 9 is provided on the outer periphery of the porous dielectric, and the transmission line 5 is provided with a thermoplastic dielectric sheath 10 made of a vinyl chloride resin and having a rectangular cross-section on its outermost periphery.

With the structure in accordance with this embodiment, it was possible to attain an average propagation delay time of 3.53 ns./m in the case where the specific gravity of the porous plastic dielectric 8 was 0.2 to 0.3 and in which an aluminum/polyester layup tape was employed as the outer conductor 9.

Figure 3:
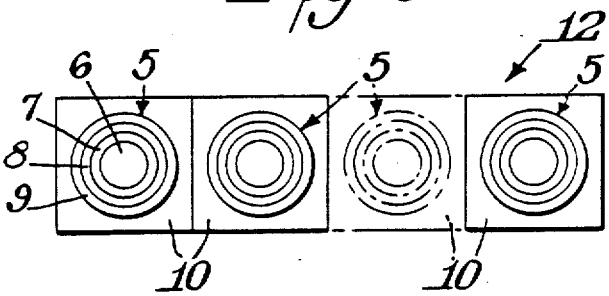
FIG. 3 is an end elevational view of a plurality of the cables of FIG. 2 fuse bonded together at their respective interfaces to form a multi-conductor flat cable.

The coaxial transmission line 5 in accordance with this embodiment can be employed as a single element as shown in FIG. 2 and it is also possible to employ the coaxial transmission line 5 in a flat cable, a rattan-blind-like coaxial flat cable, or the like, by disposing a plurality of coaxial transmission lines 5 parallel to each other and connecting, for example, the respective rectangular sheath surfaces of the transmission lines 5 to each other by fusion bonding as shown in FIG. 3.

Thus, according to the present invention, a transmission line is provided which comprises a conductor, a porous plastic dielectric provided on the outer periphery of the conductor and having a specific gravity of 0.5 or less, and an outer sheath made of a thermoplastic dielectric, the melting temperature of which is 60% or less of the melting temperature of the porous plastic dielectric. It is therefore possible to provide a cable having the sheath without increasing the specific gravity of the inner porous plastic dielectric on the outer periphery of the conductor. Further, because the porous dielectric is protected by the sheath, it is possible to provide a stable high-speed transmission line. More specifically, it is possible according to the present invention, to obtain a cable having an average propagation delay time of 3.53 ns./m. Under certain conditions, it is possible to obtain a transmission line in which the propagation delay time is about 3.4 ns./m. As a consequence, it is possible to obtain a transmission line which attains a very high signal propagation speed, which is about 98% of the velocity of light.

It is noted that the present invention is not necessarily limited to the above embodiments, and various changes and modifications may be imparted thereto within the scope of the present invention. For example, a material other than polytetrafluoroethylene may be employed as the porous plastic dielectric.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An electrical transmission line comprising a center conductor, a porous plastic dielectric material disposed around the periphery of said conductor, the porous plastic dielectric material having specific gravity of 0.5 or less, and a plastic dielectric outer sheath disposed around the outer periphery of the porous plastic dielectric material, the outer sheath having a melting temperature which is 60% or less than the melting temperature of the porous plastic dielectric material, wherein said porous plastic dielectric material is expanded, porous, sintered polytetrafluoroethylene and wherein said porous plastic dielectric material is in tape form and is helically wound around said conductor at a pitch angle of 20 degrees or less with respect to the longitudinal axis of said conductor.

2. The transmission line of claim 1 wherein said outer sheath has a rectangular cross-section.

3. A multiconductor flat cable transmission line comprising a plurality of individual transmission lines, each having a rectangular cross section, bonded together at their respective interfaces, wherein each said individual transmission line comprises a center conductor, a porous plastic dielectric material disposed around the outer periphery of said conductor, the porous plastic dielectric material having specific gravity of 0.5 or less, and a plastic dielectric outer sheath disposed around the outer periphery of the porous plastic dielectric material, the outer sheath having a melting temperature which is 60% or less than the melting temperature of the porous plastic dielectric material, wherein said porous plastic dielectric material is expanded, porous, sintered polytetrafluoroethylene and wherein said porous plastic dielectric material is in tape form and is helically wound around said conductor at a pitch angle of 20 degrees or less with respect to the longitudinal axis of said conductor.

* * * * *

UNITED STATES PATENT AND TRADEMARK OFFICE

CERTIFICATE OF CORRECTION

PATENT NO. : 4,701,576

DATED : October 20, 1987

INVENTOR(S) : Toshio Wada and Tatsuo Hirano

It is certified that error appears in the above-identified patent and that said Letters Patent is hereby corrected as shown below:

Title page:

In line 1 of the Abstract, the second "of" should read —or—.

In column 1, line 10, "trasmission" should read —transmission—.

In column 2, line 21, "from" should read —form—.

In column 2, line 42, "involved" should read —involves—.

Signed and Sealed this

Fourteenth Day of June, 1988

*Attest:*

*Attesting Officer*

DONALD J. QUIGG

*Commissioner of Patents and Trademarks*